United States Patent [19]

Fant et al.

[11] 4,311,578

[45] Jan. 19, 1982

[54] LIQUEFACTION PROCESS WHEREIN SOLVENTS DERIVED FROM THE MATERIAL LIQUEFIED AND CONTAINING INCREASED CONCENTRATIONS OF DONOR SPECIES ARE EMPLOYED

[75] Inventors: B. T. Fant, Kingwood; John D. Miller, Baytown; D. F. Ryan, Friendswood, all of Tex.

[73] Assignee: Exxon Research & Engineering Co., Florham Park, N.J.

[21] Appl. No.: 105,798

[22] Filed: Dec. 20, 1979

[51] Int. Cl.[3] ..... C10G 1/00

[52] U.S. Cl. ..... 208/8 LE

[58] Field of Search ..... 208/8 LE

[56] References Cited

U.S. PATENT DOCUMENTS

| | | | |
|---|---|---|---|
| 3,594,304 | 7/1971 | Seitzer et al. | 208/8 LE |
| 3,607,718 | 9/1971 | Leaders | 208/8 LE X |
| 3,645,885 | 2/1972 | Harris et al. | 208/8 LE |
| 4,082,644 | 4/1978 | Gatsis et al. | 208/8 LE |
| 4,094,766 | 6/1978 | Gorin | 208/8 LE X |

*Primary Examiner*—Curtis R. Davis
*Assistant Examiner*—William G. Wright
*Attorney, Agent, or Firm*—Wayne Hoover

[57] ABSTRACT

An improved process for the liquefaction of solid carbonaceous materials wherein a solvent or diluent derived from the solid carbonaceous material being liquefied is used to form a slurry of the solid carbonaceous material and wherein the solvent or diluent comprises from about 65 to about 85 wt. % hydroaromatic components. The solvent is prepared by first separating a solvent or diluent distillate fraction from the liquefaction product, subjecting this distillate fraction to hydrogenation and then extracting the naphthenic components from the hydrogenated product. The extracted naphthenic components are then dehydrogenated and hydrotreated to produce additional hydroaromatic components. These components are combined with the solvent or diluent distillate fraction. The solvent may also contain hydroaromatic constituents prepared by extracting naphthenic components from a heavy naphtha, dehydrogenating the same and then hydrotreating the dehydrogenated product. When the amount of solvent produced in this manner exceeds that required for steady state operation of the liquefaction process a portion of the solvent or diluent distillated fraction will be withdrawn as product.

10 Claims, 2 Drawing Figures

LIQUEFACTION PROCESS WHEREIN SOLVENTS DERIVED FROM THE MATERIAL LIQUEFIED AND CONTAINING INCREASED CONCENTRATIONS OF DONOR SPECIES ARE EMPLOYED

The Government of the U.S. of America has rights in this invention pursuant to Contract No. EF-77-A-01-2893 awarded by the U.S. Energy Research and Development Association, now the U.S. Department of Energy.

BACKGROUND OF THE INVENTION

This invention relates to an improved process for converting coal or similar solid carbonaceous materials. More particularly, this invention relates to an improved process for liquefying coal and similar carbonaceous substances.

As is well known, coal has long been used as a fuel in many areas. For several reasons, such as handling problems, waste disposal problems, polution problems and the like, coal has not been a particularly desirable fuel from the ultimate consumers point of view. Moreover, coal cannot be used directly, especially in areas where a liquid fuel is required, such as in the operation of automobiles, trucks and airplanes. As a result, oil and gas have enjoyed a dominant position, from the standpoint of fuel sources throughout the world.

As is also well known, proven petroleum and gas reserves are shrinking throughout the world and the need for alternate sources of energy is becoming more and more apparent. One such alternate source is, of course, coal since coal is an abundant fossil fuel in many countries throughout the world. Before coal will be widely accepted as a fuel, however, it is believed necessary to convert the same to a form which will not suffer from the several disadvantages alluded to previously and which will permit the use of those areas where a liquid fuel is normally required.

To this end, several processes wherein coal is liquefied have been proposed heretofore. Of these several liquefaction processes which have been heretofore proposed, those processes wherein coal is liquefied in the presence of a hydrogen donor solvent or diluent and molecular hydrogen appear to offer the greater advantages. In these processes, liquefaction is accomplished at elevated temperatures and pressures and a relatively broad range of gaseous and liquid hydrocarbon products is invariably produced.

For the most part, hydrogen donor solvents or diluents which are derived from the solid carbonaceous material subjected to liquefaction are employed in these processes. In these processes, then, the solvent or diluent is obtained by subjecting all or a portion of a particular distillate fraction of the liquefaction product to hydrogenation to increase the hydrogen donor species content thereof. It is, however, difficult to obtain a solvent containing more than about 50 to about 55 wt. % donatable hydrogen species. As a result, higher yields of of lower quality than would be obtained if a pure hydrogen donor solvent were employed. The higher gas yields, in turn, result in a higher consumption of molecular hydrogen without a corresponding improvement in liquid quality and the lower quality liquid product requires severe hydrotreating before an acceptable liquid is, generally, obtained. The need, therefore, for a liquefaction process wherein lower yields of gaseous products are realized and an improved quality liquid product is obtained without the inherent cost associated with the use of pure components capable of donating large percentages of hydrogen is believed readily apparent.

SUMMARY OF THE INVENTION

It has now been discovered that the foregoing and other disadvantages of the prior art processes can be reduced with the method of the present invention and an improved liquefaction process provided thereby. It is, therefore, an object of this invention to provide an improved liquefaction process. It is another object of this invention to provide such a liquefaction process wherein a solvent or diluent derived from the solid carbonaceous material subjected to liquefaction but containing a higher percentage of donatable hydrogen species is employed. It is still another object of this invention to provide such an improved liquefaction process wherein lower yields of gaseous products and an associated reduction in hydrogen consumption is realized. The foregoing and other objects and advantages will become apparent from the description set forth hereinafter and from the drawings appended thereto.

In accordance with the present invention, the foregoing and other objects and advantages are accomplished by liquefying a coal or similar solid carbonaceous material in the presence of a hydrogen donor solvent or diluent which is derived from the solid carbonaceous material subjected to liquefaction at elevated temperatures and pressures. As pointed out more fully hereinafter, the concentration of hydrogen donor species in the solvent employed is increased by selectively extracting at least a portion of the normally "non-donor" liquefaction product species and then converting at least a portion of the extracted non-donor species to "hydrogen donor" species. The "non-donor" species actually subjected to conversion may be contained, initially, in the distillate fraction selected for use as a solvent or diluent or the same may be selectively extracted from other distillate fractions of the liquefaction product.

DETAILED DESCRIPTION OF THE INVENTION

Figure 1:
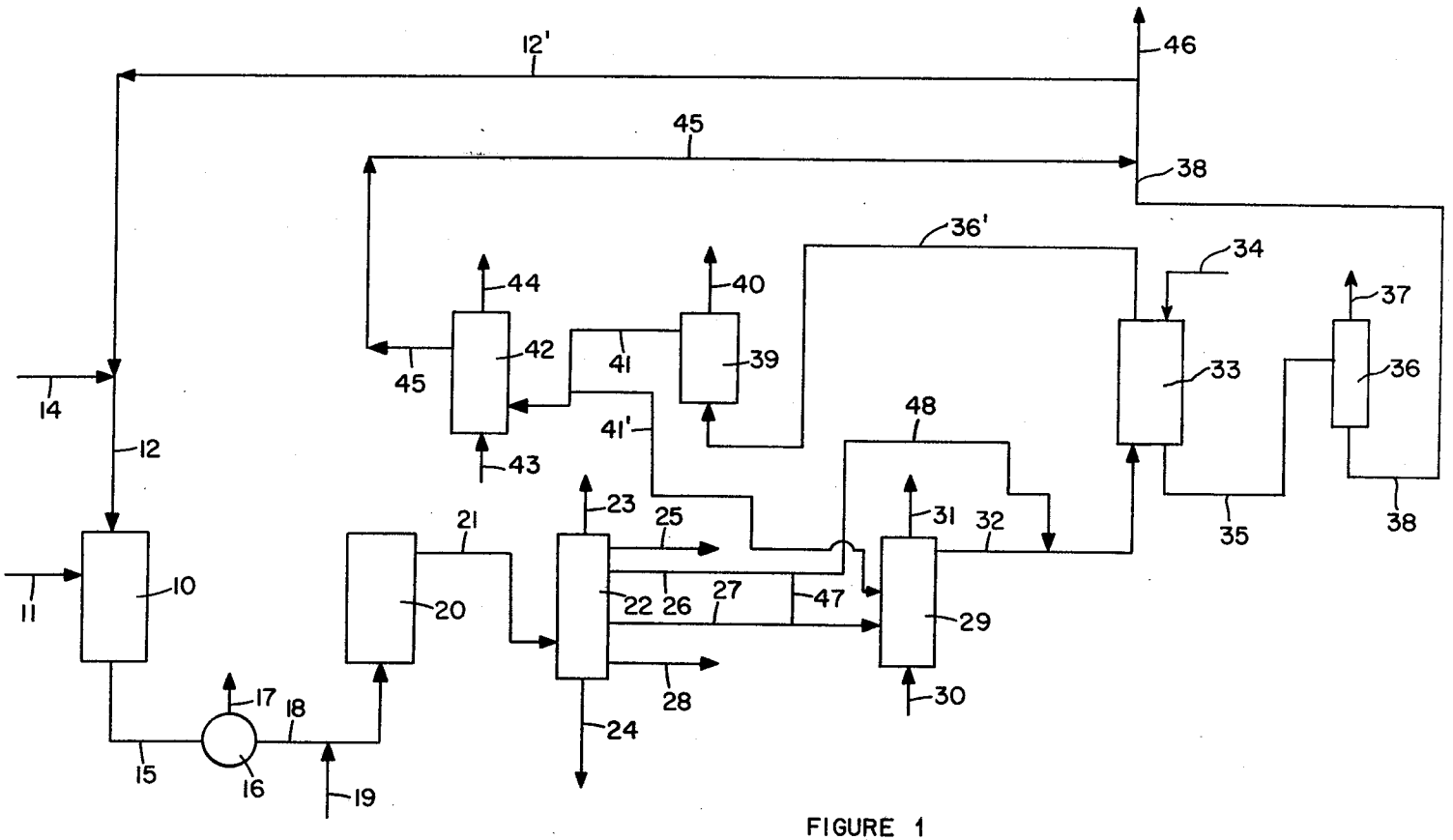
FIG. 1 is a schematic flow diagram of a process within the scope of the present invention.

As indicated supra, the present invention relates to an improved process for liquefying coal and similar solid carbonaceous materials wherein a hydrogen donor solvent or diluent which is derived from the solid carbonaceous material being subjected to liquefaction and containing a greater concentration of hydrogen donor species is employed. The increase in hydrogen donor species concentration is achieved by selectively extracting non-donor species from at least a portion of the liquid product and converting at least a portion of the extracted species to donor species. The species actually subjected to dehydrogenation may, initially, be contained in the solvent or diluent distillate fraction or the same may be selectively extracted from other distillate fractions.

In general, the method of the present invention may be used to liquefy any solid carbonaceous material which can, effectively, be hydrogenated and thus liquefied. The method of this invention is particularly useful in the liquefaction of coal and may be used to liquefy any of the coals known in the prior art including anthracite, bitumminous coal, subbitumminous coal, lignite, peat, brown coal and the like.

In general, the solid carbonaceous material will be ground to a finely divided state. The particular particle size, or particle size range, actually employed, however, is not critical to the invention and, indeed, essentially any particle size or particle size range may be employed. Notwithstanding this, generally, the solid carbonaceous material which is liquefied in accordance with this invention will be ground to a particle size of less than ¼" and preferably to a particle size of less than about 8 mesh (NBS sieve size).

After the solid carbonaceous material has been sized, the same will then be slurried with a hydrogen donor solvent or diluent. Normally the ratio of solvent or diluent to coal (on a moisture-free basis) in the slurry will be within the range from about 0.8:1 to about 10:1 on a weight basis.

In general, and as indicated previously, the solvent or diluent will be derived from the solid carbonaceous material subjected to liquefaction. The solvent or diluent will be prepared in accordance with the improved method of the present invention which will be more fully described hereinafter. In general, the solvent will comprise a plurality of hydrogen donor species, which species are believed well known in the prior art and many are described in U.S. Pat. No. 3,867,327. These include the indanes, the dihydronaphthalenes, the $C_{10}$–$C_{12}$ tetrahydronaphthalenes, the hexahydrofluorenes, the dihydro-, tetrahydro-, hexahydro- and octahydro-phenanthrenes, the $C_{12}$–$C_{13}$ acenaphthenes, the tetrahydro-, hexahydro- and decahydropyrenes, the di-, tetra- and octahydroanthracenes and other derivatives of partially saturated aromatic compounds. As indicated more fully hereinafter, solvents containing these species may be prepared by subjecting all or a portion of a distillate fraction from the liquefaction product to hydrogenation. Particularly effective distillate fractions include those having an initial boiling point within the range from about 350° to about 450° F. and a final boiling range within the range from about 650° to about 950° F.

After the solid carbonaceous material has been slurried, the slurry will then be subjected to liquefaction at a temperature within the range from about 700° to about 1000° F. and at a pressure from within the range from about 1000 to about 3000 psig in the presence of from about 2 to about 10 wt. % molecular hydrogen, based on dry solid carbonaceous material. In general, the total nominal holding time during liquefaction will range from about 10 to about 200 minutes and the liquefaction may be accomplished in a single liquefaction zone or in a plurality of such zones.

In general, the liquefaction will result in the production of gaseous product, a liquids product and a normally solid bottoms product. After liquefaction, these products will be separated into respective phases using conventional techniques. For example, the gaseous product may be simply flashed overhead and the liquids and solids then separated using filtration, centrifugation or distillation. Of these, distillation is preferred since it affords the cleanest and most controllable means of separating liquids and solids.

After separation, the gaseous product may be upgraded to a pipeline gas or the same may be burned to provide energy for the liquefaction process. Alternatively, all or a portion of the gaseous product may be reformed to provide hydrogen for the liquefaction process.

The liquid product may be fractionated into essentially any desired product distribution and/or a portion thereof may be used directly as a fuel or upgraded using conventional techniques. A portion of the liquids will, however, be separated and used as a solvent or diluent in the liquefaction process of this invention. In accordance with the improved method of this invention, the solvent or diluent fraction will be hydrogenated to increase the amount of donatable hydrogen therein prior to use as a solvent or diluent. At least a portion of the completely saturated components in the solvent fraction will, then, be selectively extracted and at least a portion of the extracted constituents will be converted to hydrogen donor species and recombined with the solvent or diluent fraction. Moreover, and when desired, completely saturated species from other distillate fractions of the liquefaction product may be selectively extracted, and converted to the corresponding donatable hydrogen species and combined with the solvent or diluent distillate fraction.

Finally, the bottoms may be burned directly to produce energy for the liquefaction process or gasified to produce either an intermediate BTU fuel gas or hydrogen for use in the liquefaction process. Alternatively, and especially where substantially all of the carbonaceous material is liquefied, the bottoms may simply be discarded.

As is well known, the coal liquids are an extremely complex mixture of saturated and unsaturated compounds including aromatic, hydroaromatic, naphthoaromatic and heteroaromatic compounds. It has been estimated that the number of individual carbon homologs in the liquefaction product is at least two or three thousand and that the number of individual components is at least a magnitude larger. In general, the liquid product will have an initial boiling point within the range from about 100° to about 200° F. and a final boiling point within the range from about 950° to about 1150° F., depending primarily upon the method used to effect separation between the liquid and solid phases of the reaction product. In general, the saturates contained in the liquefaction product will have generic formula ranging from $C_nH_{2n+2}$ to $C_nH_{2n-14}$. The aromatic hydrocarbon components will generally contain from 1 to 7 rings.

While the coal liquid product is extremely complex, it is well known that the same contains several components which are known to be capable of donating hydrogen at liquefaction conditions. In general, the components capable of donating hydrogen are hydroaromatic compounds containing benzilic carbons or hydrogens. In the conventional solvent or diluent boiling range, the hydrogen donor components will contain 2, 3 and 4 rings wherein at least one terminal ring is at least partially saturated. A common hydrogen donor in this group is, then, tetralin which may be represented structurally as follows:

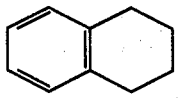

Two of the more common three-ring hydrogen donor species are tetra- and octahydrophenanthrene. These components may be represented structurally and respectively by the following formulae:

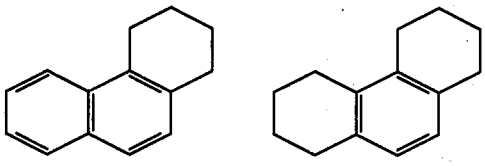

Illustrative of the four-ring hydrogen donor species are tetrahydropyrene and tetrahydrochrysene. These compounds are represented structurally and respectively by the following formulae:

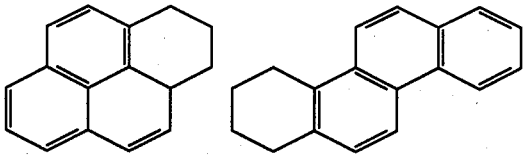

As will be apparent from the foregoing formulae, the known hydrogen donors contain at least one aromatic ring and one ring which is at least partially saturated. When hydrogen is liberated, the saturated ring or rings are converted to a corresponding but less saturated ring. When a 6-member ring is involved, the hydrogen donor component may be converted to the corresponding aromatic component. It will, of course, be appreciated that while the hydrogen donor species have been illustrated with 6-member rings, combined 5- and 6-member ring compounds are known and are effective hydrogen-donor species. Moreover, substituted homologs of these compounds and particularly those containing hydrocarbonaceous side chains are contained, generally, in a coal liquefaction product and many are known to be effective hydrogen donors during liquefaction.

As is also well known, coal liquefaction products contain completely aromatic constituents corresponding in structure to the "hydrogen donor" components illustrated above. Moreover, and as is well known in the prior art, these corresponding aromatic components may be converted to hydrogen donor species by partial hydrogenation thereof to form the corresponding hydrogen donor species previously illustrated. Conventional hydrogenation techniques, however, cannot be controlled to the extent required to ensure only partial hydrogenation and, while relatively mild conditions can be used such that solvents or diluents containing from about 50 to about 55 wt % hydrogen donor species are produced, a portion of the original aromatics and hydroaromatics contained in any given solvent or diluent distillate fraction will be hydrogenated completely. Moreover, any given distillation fraction will contain completely saturated components corresponding, generally, to saturated components of the structures previously illustrated. Since completely saturated materials boil generally at a lower boiling point than the corresponding hydroaromatics and aromatic compounds, however, any given distillate fraction may not contain completely saturated versions of all of the compounds previously illustrated. For example, if one were to select a 400° F. to 800° F. distillate fraction as the solvent or distillate fraction, the same would contain naphthalene and tetralin but would not contain decalin. Such variations in boiling point are, however, well known in the prior art and no attempt will be made herein to identify all of the components that might be contained in a solvent or diluent distillate fraction as a function of the initial and final boiling points.

Figure 2:
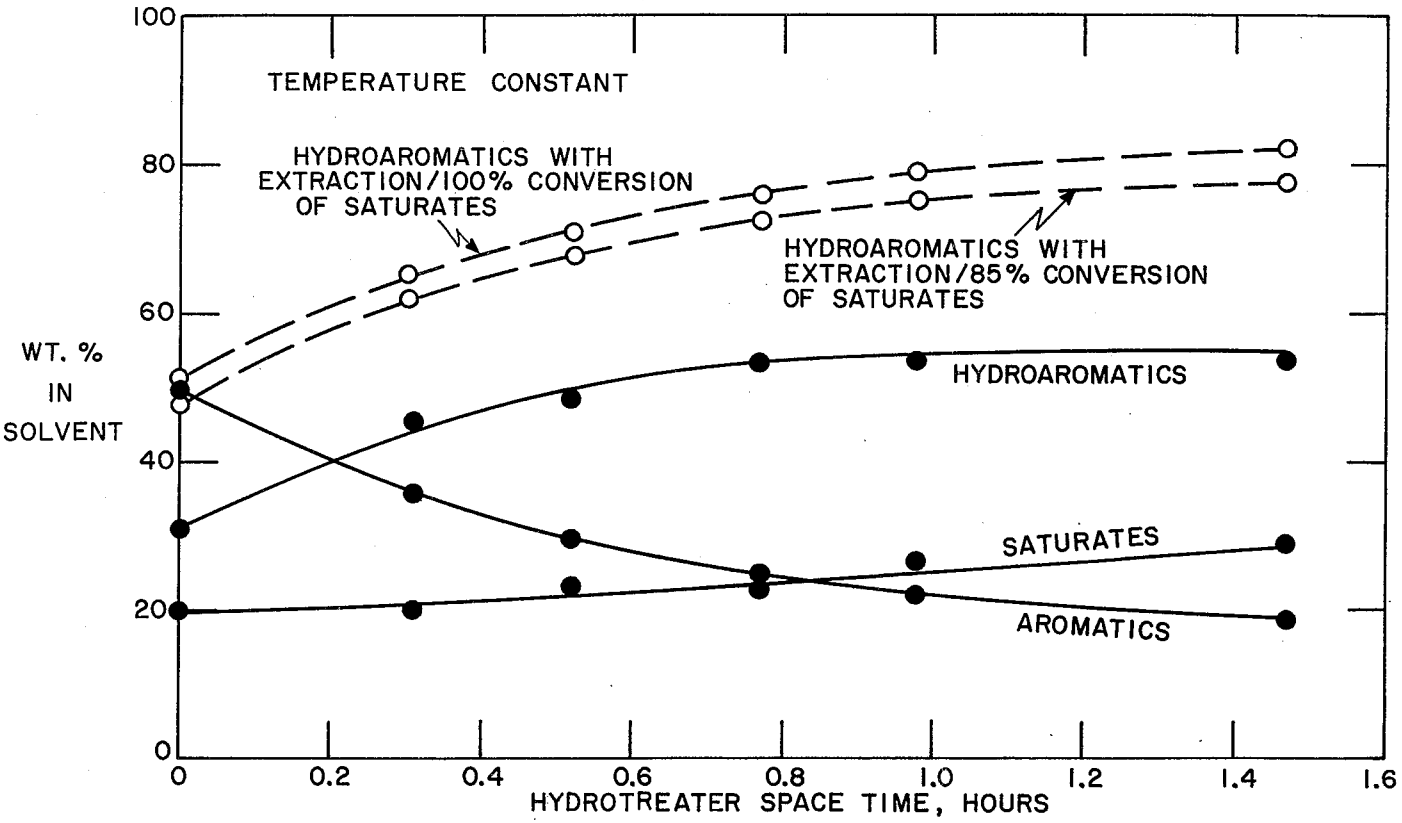
FIG. 2 is a plot showing the amount of donor and non-donor species normally contained in a solvent distillate fraction as a function of hydrogenation conditions and the improvement that may be realized in one embodiment of this invention.

As previously indicated, it is known in the prior art to hydrogenate selected distillate fractions for use as a solvent or diluent in the liquefaction operation. Heretofore, however, it has not been possible to obtain solvents or diluents containing more than about 45 to about 50 wt. % hydrogen donor species due firstly to the presence of completely saturated materials in any given distillate fraction and secondly to the conversion of aromatic and hydroaromatic components to the corresponding completely saturated materials during hydrogenation. In accordance with the present invention, then, the amount of hydrogen donor species in the solvent is increased by selectively extracting at least a portion of the completely saturated, naphthenic type compounds and converting at least a portion of these naphthenic compounds to the corresponding hydroaromatic. When the naphthenic compounds in the solvent or diluent distillate fractions are extracted, converted and recombined, and as illustrated in FIG. 2, solvents or diluents containing from about 65 to about 85 wt. % hydrogen donor species can be obtained. Moreover, the total amount of hydrogen donor solvent or diluent may be further increased by selectively extracting saturated, naphthenic components from other distillate fractions, converting the same to the corresponding hydroaromatic and then combining the hydrogen donor species with the solvent fraction.

In general, the conversion of the extracted naphthenic components will be accomplished first by dehydrogenating the naphthenic components to the corresponding aromatic components and then partially hydrogenating the aromatic components to the corresponding hydroaromatic components. In general, the partial hydrogenation may be accomplished in a separate step or by combining the dehydrogenated product with the feed to the solvent hydrogenation step or unit.

The selective dehydrogenation may be accomplished using any of the known hydrogenation catalyst at "dehydrogenation conditions." Particularly effective catalyst include those comprising one or more group VIII non-noble, or iron group metals, in combination with one or more group VI-B metals of the periodic table. Generally, such catalysts will be supported on alumina, silica alumina or a similar support. Particularly effective combinations comprise the oxide or sulfide form of the Group VIII metal in combination with the oxide or sulfide form of the Group VI metal. Particularly effective combinations include, then, the oxides and/or sulfides of cobalt-molybdenum, nickel-molybdenum, nickel-tungsten, nickel-molybdenum-tungsten, cobalt-nickel-molybdenum and the like. A particularly effective cobalt-molybdenum catalyst is one comprising from about 1 to about 10 wt. % cobalt oxide, preferably from about 2 to about 5% cobalt oxide and from about 10 to about 30 wt. % molybdenum oxide. A particularly effective nickel-molybdenum catalyst will comprise from about 10 to about 25 wt. % nickel oxide, preferably from about 15 to about 20 wt. % nickel oxide, and from about 2 to about 5 wt. % molybdenum oxide. Such catalyst will, of course, be prepared in accordance with known techniques and many are available commercially.

In general, any of the methods known to be effective in the prior art may be used to effect the selective extraction of aromatic compounds from the naphthenic components in the process of this invention. For example, the aromatic components can be extracted with solvents such as diethylene glycol, tetraethylene glycol, tetrahydrothiophene 1,1 dioxide, n-methylpyrrolidone, dimethylsulphoxide and with aqueous solutions of these solvents. Similarly, the aromatic components may be extracted using liquid ammonia, liquid $SO_2$ and similar solvents. After extraction, the saturated components will be selectively dehydrogenated in the manner previously described. When saturated materials are selectively extracted from other distillate fractions, the extraction will be accomplished in the same manner as that contemplated for use in the extraction of saturated materials from the solvent. After extraction, these saturated materials may also be subjected to selective dehydrogenation.

In general, the hydrogenation and/or rehydrogenation will be accomplished at a temperature within the range from about 600° to about 950° F. in a hydrogen atmosphere and in the presence of a suitable hydrogenation catalyst. In general, the hydrogen treat rate during hydrogenation will be between about 1000 and 10,000 SCF/bbl and the hydrogenation will be accomplished at a pressure within the range from about 650 to about 2000 psia. In general, any of the aforedescribed hydrogenation catalysts may be used to effect the desired hydrogenation.

PREFERRED EMBODIMENT

In a preferred embodiment of the present invention, a solvent distillation fraction will be cut from the liquefaction product and at least a portion of this distillate fraction will be catalytically hydrogenated at a temperature within the range from about 650° to about 800° F., a pressure within the range from about 1000 to about 1750 psia and at a hydrogen treat rate within the range from about 2000 to about 5000 SCF/bbl. In the preferred embodiment, a catalyst comprising from about 15 to about 20 wt. % nickel oxide and from about 2 to about 5 wt. % molybdenum oxide supported on an alumina carrier will be used to effect the hydrogenation. Following the hydrogenation, the completely saturated (naphthenic) compounds will be extracted by passing the hydrogenated distillate fraction through a counter current extraction unit using tetrahydrothiophene 1,1 dioxide as the extraction solvent. In the preferred embodiment, the hydrogenated distillate fraction will be contacted with from about 2 to about 6 volumes of selective solvent per volume of hydrogenated solvent. Generally, the counter-current extraction will be accomplished at a temperature within the range from about 50° to about 150° F. and at a pressure within the range from about 0 to about 45 psig. After the extraction, the naphthenic components will be separate from the aromatic containing solvent and dehydrogenated.

The dehydrogenation will be accomplished at a temperture within the range from about 650° to about 850° F., a total pressure within the range from about 300 to about 1500 psig, preferably within the range from about 500 to about 1000 psig, and at a hydrogen partial pressure within the range from about 30 to about 1000 psig, preferably within the range from about 100 to about 500 psig. The dehydrogenation will, preferably, be accomplished in the presence of a catalyst identical to that employed in the hydrogenation step. At these conditions, the naphthenic constituents will be converted to the corresponding aromatic constituents. The product from the dehydrogenation step will, then be subjected to a mild hydrogenation to convert the aromatic constituents to the corresponding hydroaromatic constituents, and hence, to hydrogen donor species. Preferably, the hydrogenation will be accomplished at a temperature within the range from about 650° to about 800° F., a pressure within the range from about 1000 to about 1750 psig and at a hydrogen treat rate within the range from about 2000 to about 5000 SCF/bbl. Hydrogen from the dehydrogenation step may be recovered and combined with the hydrogen used either during liquefaction or in any of the hydrogenation steps.

In a most preferred embodiment, and particularly those embodiments wherein the solid carbonaceous material does not normally yield a sufficient quantity of solvent or diluent, the process will be operated such that the naphthenic materials contained in the 350° F.–400° F. distillate fraction are extracted, subjected to dehydrogenation and then hydrotreated to yield still additional hydrogen donor solvent or diluent species. Inclusion of these species in the solvent may be accomplished either by including the 350° F.–400° F. fraction in the original solvent or diluent distillate fraction or by selectively extracting the naphthenic materials from this fraction separately. Since this fraction will contain from about 10 to about 40 wt. % tetralin, however, it would be most advantageous to include this fraction in the solvent or diluent distillate fraction originally.

In the preferred embodiment, the solvent or distillate fraction will have an initial boiling point of about 350° F. and a final boiling point within the range from about 750° to about 850° F. In the most preferred embodiment, the solvent or diluent distillate fraction will have an initial boiling point of about 350° F. and a final boiling point of 800° F.

It is believed that the invention will be even better understood by reference to the attached FIG. 1 which illustrates a particularly preferred embodiment. Referring then to FIG. 1, a finely divided coal or similar solid cabonaceous material is introduced into mixing vessel 10 through line 11 and slurried with a hydrogen donor solvent or diluent introduced through line 12. At steady state, and in accordance with this invention, the solvent or diluent will be derived from the solid being subjected to liquefaction and will contain from about 75 to about 85 wt. % hydrogen donor solvent or diluent species. During start up, however, or when recycle solvent is not available, any of the known useful hydrogen donor solvents or diluents may be introduced into line 12 through line 14.

The slurry is withdrawn from mixing vessel 10 through line 15 and passed through preheater 16. In the preheater 16, the slurry will, generally, be preheated to the temperature described for liquefaction. When desired, and particularly when the solid carbonaceous material has not been previously dried, steam will be flashed overhead through line 17.

In general, the slurry of solid carbonaceous material will be combined with molecular hydrogen. The molecular hydrogen may be added to the slurry either prior to or after preheating. In the embodiment illustrated, however, the preheated slurry is withdrawn from the preheater through line 18 and hydrogen is introduced through line 19. Hydrogen from any source may be used but in a preferred embodiment, the hydrogen will be produced either by the steam reforming of at least a portion of the product gas from the liquefaction or by gasification of at least a portion of the liquefaction bottoms. Such hydrogen production will be accomplished in accordance with conventional technology. In general, sufficient hydrogen will be introduced to provide from about 2 to about 10 wt. % molecular hydrogen based on dry, solid carbonaceous material.

The combined slurry hydrogen mixture is then passed directly to liquefaction vessel 20. In the liquefaction vessel 20, the solid carbonaceous material is at least partially liquefied and, generally, at least partially gasified. Preferably, the liquefaction vessel will be sized so as to provide a nominal holding time within the range from about 40 to about 140 minutes and, while a single vessel has been illustrated, a plurality of vessels may be employed. Also, the temperature within the liquefaction zone will, preferably, be within the range from about 800° to about 880° F. and the liquefaction will be accomplished at a pressure within the range from about 1200 to about 1800 psig.

In the embodiment illustrated, the combined product from liquefaction vessel 20 is withdrawn through line 21 and passed to separating means 22. In general, any suitable separating means may be employed, but a combined atmospheric and vacuum distillation column is preferred. In the embodiment illustrated, then, and when a distillation column or combination thereof is employed a gaseous product will be withdrawn overhead through line 23 and unconverted solid carbonaceous material, mineral matter and converted materials boiling at a temperature above about 950° to about 1050° F. are withdrawn through line 24. The liquid product is then fractionated into desired fractions and in the embodiment illustrated, a naphtha product boiling within the range from about 150° to about 350° F. is withdrawn through line 25, a heavy naphtha fraction boiling within the range from about 350° F. to about 400° F. is withdrawn through line 26, a solvent distillate fraction boiling within the range from about 400° F. to about 750° to about 850° F. is withdrawn through line 27 and a heavy liquid having an initial boiling point within the range from about 750° to about 850° F. and a final boiling point within the range of from about 950° to about 1050° F. is withdrawn through line 28.

In general, the overhead gaseous material will comprise gaseous and lower boiling hydrocarbons, steam, acid gases such as $SO_2$ and $H_2S$ and any ammonia which may have been produced during liquefaction. This stream may be scrubbed and further divided to yield a high BTU gas and lighter hydrocarbons. The naphtha stream may be subjected to further upgrading to yield a good quality gasoline and the heavier stream withdrawn through line 24 may be upgraded to produce a heavy fuel oil or cracked and reformed to yield a gasoline boiling fraction. Generally, the solvent boiling range material or at least a portion thereof will be hydrogenated to increase the concentration of hydrogen donor species, the naphthenic components contained in the hydrogenated product selectively extracted and dehydrogenated and then recombined with the solvent distillate fraction. Also, naphthenic components in the heavy naphtha withdrawn through line 26 may be selectively extracted and dehydrogenated with the dehydrogenated components being combined with the solvent fraction or the entire naphtha fraction may be combined with the solvent or diluent distillate fraction prior to the hydrogenation of this distillate fraction.

In general, the solvent distillate fraction withdrawn through line 27 will contain 2, 3 and 4 ring aromatic compounds, 2, 3 and 4 ring hydroaromatics; and 2, 3 and 4-ring naphthenic components and homologs of each of these compounds. Generally, the solvent or diluent distillate fraction will contain from about 30 to about 75 wt. % aromatics, from about 15 to about 30 wt. % hydroaromatics and from about 10 to about 40 wt. % naphthenic constituents. In the embodiment illustrated, then, this stream will be catalytically hydrogented in hydrogenation vessel 29 with molecular hydrogen introduced through line 30. The hydrogen actually used may be from any source, but in a preferred embodiment will be produced either through the steam reforming of at least a portion of the gaseous product from liquefaction or by gasification of at last a portion of the bottoms. In the embodiment illustrated, unreacted hydrogen and the gaseous products of hydrogenation are withdrawn through line 31. When desired, this gaseous product may be treated to recover recycle hydrogen. Also in the embodiment illustrated, the hydrogenated product is withdrawn through line 32.

Generally, the hydrogenation will be accomplished at a temperature within the range from about 600° F. to about 950° F. and at a pressure within the range from about 650 to about 2000 psig. The hydrogen treat rate during the hydrogenation generally will be within the range from about 1000 to about 10,000 SCF/bbl. Any of the known hydrogenation catalyst may be employed. The hydrogenation product withdrawn through lines 32 will, generally and as illustrated in FIG. 2, contain from about 20 to about 50 wt. % aromatics, from about 30 to about 55 wt. % hydroaromatics or hydrogen donor species and from about 20 to about 30 wt. % naphthenic components.

In the preferred embodiment, the total liquid hydrogenation effluent will be passed directly to a counter-current extraction unit 33. In the counter-current extraction unit, the hydrogenated product will be contacted with a solvent to extract the naphthenic components. As previously indicated, any of the known suitable solvents may be used. In the embodiment illustrated, the solvent is introduced through line 34 and the selective solvent containing extracted aromatic and hydroaromatic materials are withdrawn through line 35. The extracted aromatic and hydroaromatic stream will, after separation from selective solvent generally, contain from about 15 to about 70 wt. % aromatics and from 30 to about 85 wt. % hydroaromatics.

The extracted aromatic and hydroaromatic components which are withdrawn through line 35 will be separated from the extraction solvent in separator 36. The particular means used to effect the separation will vary with the solvent, but in the embodiment illustrated, the solvent is flashed overhead and recovered through line 37 and the aromatic and hydroaromatic materials withdrawn through line 38.

The naphthenic materials are withdrawn through line 36 and then dehydrogenated in dehydrogenation vessel 39. In the dehydrogenation vessel, the naphthenic materials are passed over a suitable hydrogenation catalyst which, preferably, will be identical to the catalyst used in hydrogenation. Preferably, the dehydrogenation will be accomplished at a temperature within the range from about 650° to about 850° F., a pressure within the range from about 500 to about 1000 psig, and at a hydrogen partial pressure within the range from about 100 to about 500 psig. Hydrogen from the dehydrogenation is withdrawn through line 40 and the dehydrogenated naphthenic components are withdrawn through line 41.

Generally, the dehydrogenated naphthenic materials withdrawn through line 41 will, after dehydrogenation, comprise from about 70 to about 100 wt. % aromatics and from about 0 to about 30 wt. % hydroaromatics. To increase the concentration of hydroaromatics, then, this stream will, generally, be hydrotreated to convert at least a portion of the aromatics to the corresponding hydroaromatics. In the embodiments illustrated, this will be accomplished in hydrotreater 42 or by combining the dehydrogenated materials with the feed to hydrogenation unit 29. In the embodiment illustrated, and when the hydrogenation is accomplished separately, the hydrotreating is preferably accomplished at a temperature within the range from about 650° to about 800° F., a pressure within the range from about 1000 to about 1500 psig and at a hydrogen treat rate within the range from about 2000 to about 5000 SCF/bbl. Hydrogen is introduced through line 43. Unreacted hydrogen and any gaseous products from the hydrotreating are withdrawn through line 44. The hydrotreated product is then withdrawn through line 45. This product will, then, be combined with the liquefaction solvent or diluent fraction in line 38.

When the dehydrogenated naphthenic materials are combined with the feed to hydrogenation unit, this may be accomplished by passing the product in line 41 to the hydrogenation unit 29 through line 41'. When this is done, the hydrotreater 42 and the associated piping may be eliminated and the solvent withdrawn through line 36 will contain an increased amount of hydroaromatics.

In those cases where the amount of total liquid available in line 38 after the introduction of the dehydrogenated naphthenic components through line 45, when separate hydrotreating is employed, exceeds the amount of solvents required during liquefaction, a portion of this material may be withdrawn through line 46 and either stored for future use or used as a fuel product. In those cases where the liquid available after this combination would not normally be sufficient to supply solvent demands, additional solvent may be produced by combining all or a portion of the heavy naphtha withdrawn through line 26 with the solvent fraction withdrawn through line 27 prior to hydrogenation. Such a transfer could be effected through line 47. Alternatively, all or a portion of this fraction could bypass the hydrogenator and be fed directly to the naphthenic extraction step. In this case, the transfer could be effected through line 48 into line 32. When this is done, the naphthenic materials in the heavy naphtha would be extracted in extraction vessel 33 and then subjected to dehydrogenation in dehydrogenation vessel 36.

Having thus broadly described the present invention and a preferred embodiment thereof, it is believed that the same will become more apparent by reference to the following examples. It will be appreciated, however, that the examples are presented solely for purposes of illustration and should not be construed as limiting the invention.

EXAMPLE 1

In this example, a run was completed in a 50 pound/-day continuous unit at a pressure of 1500 psig and a temperature of 840° F. During this run, an Illinois #6 coal was liquefied and at steady state a hydrogenated 400°–800° F. distillate fraction was recycled as solvent. The conditions employed, the total gas yield was 23 lbs/100 lbs of dry coal and the hydrogen consumption during liquefaction was 4.12 lbs lbs of dry coal converted.

EXAMPLE 2

In this example, a run identical to the run in Example 1 was completed except that tetralin was used as the solvent. The solvent employed contained about 100 wt. % hydroaromatics. At steady state the total gas yield was 16.5 lbs/100 lbs of dry coal and the hydrogen consumption during liquefaction was 1.0 lbs/100 lbs of dry coal.

From the foregoing it is believed apparent that when solvents of increased hydrogen donor content are employed in accordance with the improved method of the present invention, several advantages over prior art processes including reduced gas yields and lower hydrogen consumption are employed.

While the present invention has been described and illustrated by reference to particular embodiments thereof, it will be appreciated by those of ordinary skill in the art that the same lends itself to variations not necessarily illustrated here. For this reason, then, reference should be made solely to the appended claims for purposes of determining the true scope of the present invention.

Having thus described and illustrated the invention, what is claimed is:

1. In a process for liquefying coal and similar solid carbonaceous materials wherein the solid carbonaceous material is slurried with a hydrogen donor solvent or a diluent distillate fraction derived from the solid carbonaceous material subjected to liquefaction and hydrogenated to increase the hydrogen donor species content thereof wherein the liquefaction is accomplished at elevated tempertures and pressures, the improvement which comprises extracting at least a portion of the naphthenic components from the hydrogenated solvent or diluent distillate fraction, converting at least a portion of the extracted naphthenic compounds to the corresponding hydroaromatic components and then combining at least a portion of these hydroaromatic components with the solvent or diluent distillate fraction.

2. The improvement of claim 1 wherein the solvent or diluent is a distillate fraction having an initial boiling point within the range from about 350° to about 450° F. and a final boiling point within the range from about 650° to about 950° F.

3. The improvement of claim 1 wherein naphthenic components from a heavy naphtha boiling within the range from about 350° F. to about 400° F. are also selectively extracted, converted to the corresponding hydroaromatic component and then combined with the solvent distillate fraction.

4. The improvement of claim 1 wherein a portion of the solvent or diluent distillate fraction is withdrawn from the process as a product after the converted naphthenic components have been combined therewith.

5. The improvement of claim 2 wherein the conversion of the naphthenic components is accomplished by dehydrogenating at least a portion of the naphthenic components to the corresponding aromatic components and then hydrogenating at least a portion of these aromatic components to the corresponding hydroaromatic components.

6. An improved process for the liquefaction of coal and similar solid carbonaceous materials comprising the steps of:

(a) forming a slurry of finely divided coal or similar solid carbonaceous material in a solvent or diluent having an initial boiling point within the range from about 350° to about 450° F. and a final boiling point within the range from about 650° to about 950° F., which solvent or diluent is separated from the liquefaction liquid product and hydrogenated to increase the hydrogen donor species content thereof;

(b) subjecting the slurry from step (a) to liquefaction conditions to produce a liquid product;

(c) separating a fraction from said liquid product having an initial boiling point within the range from about 350° to about 450° F. and a final boiling point within the range from about 650° F. to about 950° F.;

(d) hydrogenating at least a portion of the fraction separated in step (c) to increase the hydrogen donor species content thereof;

(e) separating at least a portion of the hydrogenated fraction from step (d) into an aromatic and hydroaromatic fraction and a naphthenic fraction;

(f) converting at least a portion of the naphthenic fraction from step (e) to a fraction comprising the corresponding hydroaromatic constituents;

(g) combining at least a portion of the hydroaromatics from step (f) with at least a portion of the aromatic and hydroaromatic fraction from step (d);

(h) using at least a portion of the combined aromatic and hydroaromatic fraction from step (g) as the solvent in step (a); and (i) recovering a liquid product from the remaining liquid from step (b).

7. The process of claim 6 wherein the solvent used in step (a) contains from about 65 to about 85 weight percent donor hydrogen species.

8. The process of claim 6 wherein the fraction obtained in step (c) has an initial boiling point of about 350° F. and a final boiling point within the range from about 750° to about 850° F.

9. The process of claim 6 wherein the fraction from step (d) has an initial boiling point of about 350° F. and a final boiling point of about 800° F.

10. The process of claim 6 wherein the naphthenic constituents are converted into the corresponding hydroaromatic constituents by first dehydrogenating the naphthenic constitutents to the corresponding aromatic constitutents and then hydrogenating the aromatic constituents to the corresponding hydroaromatic constitutents.

* * * * *